US006132838A

United States Patent [19]

Hiratsuka et al.

[11] Patent Number: 6,132,838

[45] Date of Patent: Oct. 17, 2000

[54] FUNCTIONAL CARPET AND METHOD OF PRODUCING SAME

[75] Inventors: Hideo Hiratsuka, Saitama; Kazufumi Shimizu, Nara; Hiroki Nagayama, Yokohama; Hiroaki Harata, Kanagawa, all of Japan

[73] Assignee: Nissan Motor Co., Ltd., Yokohama, Japan

[21] Appl. No.: 09/065,426

[22] Filed: Apr. 24, 1998

[30] Foreign Application Priority Data

Apr. 28, 1997 [JP] Japan ..... 9-110862

[51] Int. Cl.[7] ..... B32B 3/02; B05D 3/02

[52] U.S. Cl. ..... 428/95; 428/96; 428/97; 442/79; 442/80; 442/92; 427/393.5; 427/393.4

[58] Field of Search ..... 428/95, 97, 96; 442/79, 80, 82; 427/393.5, 243, 393.4; 521/145

[56] References Cited

U.S. PATENT DOCUMENTS 4,680,221 7/1987 Murayama et al. ..... 428/246
4,855,162 8/1989 Wrasidlo et al. ..... 427/243
5,601,910 2/1997 Murphy et al. ..... 442/79
5,763,040 6/1998 Murphy et al. ..... 428/96
5,981,614 11/1999 Adiletta ..... 521/145

*Primary Examiner*—Newton Edwards
*Attorney, Agent, or Firm*—Foley & Lardner

[57] ABSTRACT

A functional carpet suitable for use in an automotive vehicle. The functional carpet comprises a nonwoven fabric having piles formed throughout a whole surface of the nonwoven fabric. Each pile projects from the surface of the nonwoven fabric and is formed of at least a part of fibers constituting the nonwoven fabric. Each pile has a length ranging from 1 to 10 mm. The nonwoven fabric has a density ranging from 250 to 800 g/m$^2$. Additionally, a fluoroplastics is adhered to a surface portion of the nonwoven fabric and extends substantially uniformly throughout the surface of the nonwoven fabric. The fluoroplastics includes linear tetrafluoroethylene telomer as a main body. The tetrafluoroethylene telomer has a number of carbon atoms ranging from 6 to 14. The amount of the fluoroplastics adhered to the surface portion of the nonwoven fabric ranges from 1.5 to 60 g/m$^2$ in solid state.

10 Claims, No Drawings

FUNCTIONAL CARPET AND METHOD OF PRODUCING SAME

The contents of Japanese Patent Application No. 9-110862, with a filing date of Apr. 28, 1997 in Japan, are hereby incorporated by reference.

BACKGROUND OF THE INVENTION

1. Field of the Invention

This invention relates to improvements in a functional carpet having piles arranged to form a cord-tone pattern, dilour-tone pattern, velour-tone pattern or the like pattern and whose surface is treated with a surface treatment agent including fluoroplastics as a main component to provide the carpet with water repellant, oil repellant and soil resistance, and more particularly to such a functional carpet suitable in use for an automotive vehicle.

2. Description of the Prior Art

It has been hitherto well known that a carpet is coated with a general fluoroplastics emulsion serving as a surface treatment agent in order to provide the carpet with water repellant, oil repellant, soil resistance and the like. In this case, fluorocarbon compounds constituting the fluoroplastics include a large amount of ones having side-chain and a large amount of ones having relatively high molecular weight, for example, ones having the number of carbon atoms not smaller than 16. Such fluorocarbon compounds enlarge the size of molecule and becomes very bulky thereby degrading permeation of the fluoroplastics emulsion from the piled surface to the inside of a base fabric of the carpet when the fluoroplastics emulsion is coated at the surface of the base fabric of the carpet. As a result, such a carpet coated with the fluoroplastics emulsion cannot exhibit a sufficient water repellency, oil repellency, soil resistance and the like.

Besides, concerning surface treatment agents containing fluoroplastics to be used for general woven fabrics, no sufficient consideration is made to the permeability of the surface treatment agents since such surface treatment agents are required to be adhered only to the surface of the woven fabric. Accordingly, if such surface treatment agents are used for bulky fabric such as nonwoven fabric, they are low in permeability and therefore cannot exhibit desired water repellency and soil resistance.

Furthermore, with the above-mentioned and other conventional techniques, adhesion or fixation of the fluoroplastics to fibers of the carpet base fabric is accomplished only by solidification of the emulsion on the surface of the carpet base fabric upon coating of the emulsion at the surface of the carpet base fabric. In such a case, bonding force of the fluoroplastics to the fibers is weak, and therefore the water repellency, oil repellency, soil resistance and the like are inferior in durability.

As appreciated from the above, even on the assumption that the conventional surface treatment agents are applied to a carpet for use in an automotive vehicle, it is difficult that the carpet exhibits sufficient water repellency, oil repellency, soil resistance and the like and a sufficient durability of such functions. Additionally, with the conventional adhesion or fixation manner of fluoroplastics, water repellency, oil repellency, soil resistance and the like are low in durability, and therefore it is required to improve the durability of such performances.

BRIEF SUMMARY OF THE INVENTION

The prevent invention has been accomplished upon paying attention to the above drawbacks and requirements in the conventional techniques, in which the present invention employs a particular fluoroplastics, as a main component of a surface treatment agent, which is minimized in size of molecules as small as possible and lowered in bulkiness as compared with the conventional fluoroplastics. This particular fluoroplastics largely improves the permeability of the surface treatment agent to a base fabric of a carpet and therefore largely improves functions (such as water repellency, oil repellency and soil resistance) and durability of such functions, thereby overcoming the above drawbacks encountered in the conventional techniques.

It is, therefore, an object of the present invention is to provide an improved functional carpet and an improved method of producing the functional carpet which can overcome drawbacks encountered in conventional techniques for similar functional carpets and similar producing methods.

Another object of the present invention is to provide an improved functional carpet which is provided with excellent water repellency, oil repellency, soil resistance and the like, and high in durability of such functions, while maintaining good feeling of the surface portion of the carpet.

A further object of the present invention is to provide an improved production method of a functional carpet which are provided with excellent water repellency, oil repellency, soil resistance and the like, and high in durability of such functions, maintaining good feeling of the surface of the carpet, without addition of any particular and complicated operation in the production method.

An aspect of the present invention resides in a functional carpet which comprises a nonwoven fabric having piles formed throughout a whole surface of the nonwoven fabric. Each pile projects from the surface of the nonwoven fabric and is formed of at least a part of fibers constituting the nonwoven fabric. Each pile has a length ranging from 1 to 10 mm. The nonwoven fabric has a density ranging from 250 to 800 g/m$^2$. Additionally, a fluoroplastics is adhered to a surface portion of the nonwoven fabric and extends substantially uniformly throughout the surface of the nonwoven fabric. The fluoroplastics includes linear tetrafluoroethylene telomer as a main body. The tetrafluoroethylene telomer has a number of carbon atoms ranging from 6 to 14. The amount of the fluoroplastics adhered to the surface portion of the nonwoven fabric ranges from 1.5 to 60 g/m$^2$ in solid state.

Another aspect of the present invention resides in a method of producing a functional carpet, comprising the following steps in the sequence set forth: (a) preparing a nonwoven fabric having piles formed throughout a whole surface of the nonwoven fabric, each pile projecting from the surface of the nonwoven fabric and formed of at least a part of fibers constituting the nonwoven fabric, each pile having a length ranging from 1 to 10 mm, the nonwoven fabric having a density ranging from 250 to 800 g/m$^2$; (b) coating an aqueous emulsion (or surface treatment agent) at the surface of the nonwoven fabric to extend substantially uniformly throughout the surface of the nonwoven fabric, the emulsion containing fluoroplastics as a main component, in an amount ranging from 3 to 20% by weight, the fluoroplastics including linear tetrafluoroethylene telomer as a main body, the tetrafluoroethylene telomer having a number of carbon atoms ranging from 6 to 14, an amount of the aqueous emulsion coated at the surface of the nonwoven fabric ranging from 50 to 300 g per 1 m$^2$ of the nonwoven fabric; and (c) heating the nonwoven fabric coated with the aqueous emulsion coated so that the fluoroplastics is cross-linked and solidified to obtain an amount of the fluoroplastics adhered to a surface portion of the nonwoven fabric, ranging from 1.5 to 60 g/m$^2$ in solid state.

According to the present invention, the functional carpet can be provided at its surface portion with excellent water repellency, oil repellency, soil resistance and the like and high durability in such functions without degrading good feeling of the surface portion and fine appearance of the carpet by coating the aqueous emulsion (the surface treatment agent) including the fluoroplastics as the main component, onto the nonwoven fabric as the base fabric of the carpet, and then by heating the nonwoven fabric coated with the aqueous emulsion so as to accomplish cross-linking of the fluoroplastics and adhesion of the fluoroplastics to fibers of the nonwoven fabric. The nonwoven fabric is provided at its surface with the piles preferably in such a manner as to form cord-tone pattern, dilour-tone pattern, velour-tone pattern or the like pattern. Accordingly, such a functional carpet is highly suitable for use in an automotive vehicle.

DETAILED DESCRIPTION OF THE INVENTION

According to the present invention, a functional carpet comprises a nonwoven fabric having piles formed throughout a whole surface of the nonwoven fabric. Each pile projects from the surface of the nonwoven fabric and is formed of at least a part of fibers constituting the nonwoven fabric. Each pile has a length ranging from 1 to 10 mm. The nonwoven fabric has a density ranging from 250 to 800 g/m$^2$. Additionally, a fluoroplastics is adhered to a surface portion of the nonwoven fabric and extends substantially uniformly throughout the surface of the nonwoven fabric. The fluoroplastics includes linear tetrafluoroethylene telomer as a main body. The tetrafluoroethylene telomer has a number of carbon atoms ranging from 6 to 14. The amount of the fluoroplastics adhered to the surface portion of the nonwoven fabric ranges from 1.5 to 60 g/m$^2$ in solid state.

The above functional carpet is produced by a method comprising the following steps in the sequence set forth: (a) preparing a nonwoven fabric having piles formed throughout a whole surface of the nonwoven fabric, each pile projecting from the surface of the nonwoven fabric and formed of at least a part of fibers constituting the nonwoven fabric, each pile having a length ranging from 1 to 10 mm, the nonwoven fabric having a density ranging from 250 to 800 g/m$^2$; (b) coating an aqueous emulsion (or surface treatment agent) at the surface of the nonwoven fabric to extend substantially uniformly throughout the surface of the nonwoven fabric, the emulsion containing fluoroplastics as a main component, in an amount ranging from 3 to 20% by weight, the fluoroplastics including linear tetrafluoroethylene telomer as a main body, the tetrafluoroethylene telomer having a number of carbon atoms ranging from 6 to 14, an amount of the aqueous emulsion coated at the surface of the nonwoven fabric ranging from 50 to 300 g per 1 m$^2$ of the nonwoven fabric; and (c) heating the nonwoven fabric coated with the aqueous emulsion coated so that the fluoroplastics is cross-linked and solidified to obtain an amount of the fluoroplastics adhered to a surface portion of the nonwoven fabric, ranging from 1.5 to 60 g/m$^2$ in solid state.

As mentioned above, the aqueous emulsion containing fluoroplastics as the main component is used as the surface treatment agent. A major part (or main body) of the fluoroplastics is constituted of tetrafluoroethylene telomer which has, for example, the following chemical structure:

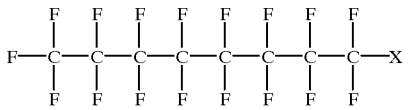

where X is a reactive functional atom or group for bonding. The tetrafluoroethylene telomer has the reactive functional atom or group such as hydrogen, chlorine, bromine, hydroxyl group and/or isocyanato group (—N=C=O) at at least one terminal thereof. Additionally, the tetrafluoroethylene telomer is linear or straightchain type so as to have no side-chain, and has the number of carbon atoms ranging from 6 to 14. It is to be noted that the abovementioned major part or main body (i.e., the tetrafluoroethylene telomer) of the fluoroplastics corresponds to an amount with which the inherent functions and effects of the tetrafluoroethylene telomer cannot be substantially suppressed or lost in the fluoroplastics. In concrete, the amount of the tetrafluoroethylene telomer in the fluoroplastics is not less than 50% by weight, preferably not less than 70% by weight, and more preferably not less than 90% by weight. In this instance, the fluoroplastics is used in the form of the aqueous emulsion as the surface treatment agent.

It is preferable that the surface treatment agent (or the aqueous emulsion of the fluoroplastics) contains a cross-linking agent for the fluoroplastics as the main component, such as polyurethane. The amount of the cross-linking agent in the surface treatment agent is within a range of from 0.1 to 5% by weight. The polyurethane is preferably used or contained in the form of an aqueous emulsion in the surface treatment agent. In this regard, it is also preferable that the tetrafluoroethylene telomer has at least one reactive functional atom or group such as hydrogen, chlorine, bromine, hydroxyl group or isocyanato group in its molecular, in which the functional atom or group can make its cross-linking under the reaction of the cross-linking agent having isocyanato group as a functional group.

The surface treatment agent is coated at the surface of the nonwoven fabric (serving as the base fabric of the carpet) and then subjected to a heat treatment to cause cross-linking and solidification of the fluoroplastics in the surface treatment agent. This heat treatment is accomplished preferably at a temperature ranging from 100 to 200° C. and for a time ranging from 20 seconds to 10 minutes under a dry condition. Thus, the functional carpet is produced to have a structure in which the fluoroplastics is adhered to or impregnated in the surface portion of the nonwoven fabric and spread uniformly throughout a whole surface of the nonwoven fabric. The main body of the fluoroplastics is the liner tetrafluoroethylene telomer having the number of carbon atoms ranging from 6 to 14 and which has been cross-linked preferably under the reaction of polyurethane. The amount of the fluoroplastics adhered to the surface portion of the nonwoven fabric is within the range of from 1.5 to 60 g/m$^2$ in solid state.

Hereinafter, the functional carpet and the method of producing the same will be discussed in detail.

The base fabric of the functional carpet according to the present invention, for an automotive vehicle is the nonwoven fabric which has piles at its surface. The piles preferably form cord-tone pattern, dilour-tone pattern, velour-tone pattern or the like pattern at the surface of the nonwoven fabric. The nonwoven fabric is constituted generally of polyester fiber, nylon fiber, acrylic fiber, polypropylene fiber and/or the like. The nonwoven fabric is preferably constituted of polyester fiber. Nylon fiber is not preferable as the material of the non-woven fabric because of expensive raw material. Acrylic fiber is not preferable as the material of the nonwoven fabric because it produces toxic gas when burnt and therefore is not desirable from the viewpoint of safety. Polypropylene fiber is not preferable as the material of the nonwoven fabric because piles formed of the fiber tends to easily fall down so that the nonwoven fabric constituted of the fiber tend to easily deform even after compression-fabrication under heating, while the fiber is inferior in wear resistance.

Polyester fiber used for constituting the piled nonwoven fabric is not particularly limited to particular ones, in which polyester fiber whose main component is polyethylene terephthalate or the like is highly preferable because it is readily available under low cost.

The nonwoven fabric as the base fabric preferably has a density (weight per unit area) ranging from 250 to 800 g/m$^2$. If the density is lower than 250 g/m$^2$, not only a sufficient shape-maintaining characteristics of the nonwoven fabric cannot be obtained but also there arises the possibility of thin or see-through sections being produced in the nonwoven fabric after fabrication because of a too small thickness of the nonwoven fabric. If the density exceeds 800 g/m$^2$, it becomes difficult to form the cord-tone pattern, the dilour-tone pattern, the velour-tone pattern or the like at the surface portion of the nonwoven fabric under the action of fork needles. Additionally, in case that the density is high to exceed 800 g/m$^2$, there is the possibility that no sufficient amount of the surface treatment agent can penetrate into the surface portion or inside of the nonwoven fabric serving as the base fabric, and therefore a desired performance of the functional carpet cannot be obtained.

The piles of the nonwoven fabric are formed projecting uniformly throughout the whole surface of the nonwoven. The piles have a length (pile length) ranging from 1 to 10 mm. If the pile length is smaller than I mm, feeling of the surface portion of the nonwoven fabric degrades while it becomes difficult to form the cord-tone pattern, the dilour-tone pattern, the velour-tone pattern or the like pattern at the surface of the nonwoven fabric under the action of the fork needles. If the pile length exceeds 10 mm, there arises the possibility of the piles tending to easily fall down while there is such a tendency that penetration of the surface treatment agent into the surface portion of the nonwoven fabric becomes insufficient.

The aqueous emulsion (or the surface treatment agent) of the fluoroplastics contains the fluoroplastics in an amount ranging from 3 to 20% by weight. The aqueous emulsion may further contain usual additives such as a dispersion-assisting agent, a surface active agent, a stabilizer, a dye or coloring agent, an antistatic agent and/or the like. If the amount of the fluoroplastics in the aqueous solution is not less than 3% by weight, fixation or adhesion of the fluoroplastics to the nonwoven fabric becomes insufficient so as to provide no uniform functions throughout the whole surface of the carpet, thus making it difficult to obtain uniform and sufficient water repellency and oil repellency throughout the whole surface of the carpet. If the amount of the fluoroplastics in the aqueous solution exceeds 20% by weight, too much fluoroplastics is adhered to the surface portion of the nonwoven fabric so that there arises the possibility of crystallization, chalking and the like of the fluoroplastics occurring after the heat treatment.

The amount of the surface treatment agent (or the aqueous solution of the fluoroplastics) to be coated at the surface of the nonwoven fabric is preferably within a range of from 50 to 300 g/m2. If the coated amount of the surface treatment agent is less than 50 g/M$^2$, uniform coating of the surface treatment agent throughout the whole surface of the nonwoven fabric is difficult so as to provide no uniform functions throughout the whole surface of the carpet, thus making it difficult to obtain uniform and sufficient water repellency and oil repellency throughout the whole surface of the carpet. If the coated amount of the surface treatment agent exceeds 300 g/M$^2$, there arises the possibility of the excessive surface active agent occurring its crystallization, chalking and the like of the fluoroplastics after the heat treatment. Additionally, a large amount of water contained in the surface treatment agent impedes rising in temperature at the surface of the nonwoven fabric, thereby not only providing insufficient drying of the nonwoven fabric coated with the surface treatment agent at a drying step but also delaying proceeding of the cross-linking reaction of the fluoroplastics. As a result, there is the possibility of lowering the durability of the functions and effects of the functional carpet.

The tetrafluoroethylene telomer forming the main component of the surface treatment agent has the reactive functional atom or group such as hydrogen, chlorine, bromine, hydroxyl group or isocyanato group at at least one terminal thereof. Additionally, the tetrafluoroethylene telomer is preferably linear or straight-chain type so as to have no side-chain, and has the number of carbon atoms ranging from 6 to 14. It is to be noted that the molecule or tetrafluoroethylene telomer having side-chain is highly bulky, and that the size of the molecule is enlarged if the number of carbon atoms of the tetrafluoroethylene telomer exceeds 14. As a result, in case of using such tetrafluoroethylene telomer outside the scope of the present invention, the permeability of the surface treatment agent into the nonwoven fabric is degraded when the surface treatment agent is coated at the surface of the nonwoven fabric so that desired functions such as water repellency, oil repellency, soil resistance and the like cannot be obtained in the resultant carpet. In case that the number of carbon atoms of the tetrafluoroethylene telomer is smaller than 6, adherence of the fluoroplastics to the fibers is largely degraded while lowering the reactivity of the fluoroplastics so that a desired density of cross-linking of the fluoroplastics cannot be obtained when the cross-linking reaction is made under the action of the cross-linking agent thus providing no sufficient water repellency.

The tetrafluoroethylene telomer is obtained by usual methods in which blowing polymerization or emulsion polymerization is carried out using tetrafluoroethylene as taxogen. As discussed above, the tetrafluoroethylene telomer is a linear polymer and has the terminal functional atom or group. This tetrafluoroethylene telomer can be produced under telomerization, and otherwise may be commercially available.

The cross-linking agent contained in the surface treatment agent is preferably polyurethane, in which the polyurethane is contained in the form of an aqueous emulsion in the surface treatment agent. The polyurethane may be of polyether type or polyester type, and has isocyanato group as the reactive functional group. Additionally, compounds having epoxy group, aldehyde group, aminoformaldehyde group and/or the like may be used as the cross-linking agent(s); however, polyurethane in the form of aqueous emulsion is particularly preferable as the cross-linking agent from the viewpoints of cross-linking condition, durability, stability against chemicals, reactivity and the like.

It is preferable that the content of the cross-linking agent in the aqueous emulsion is within a range of from 0.1 to 5% by weight relative to the weight of the aqueous emulsion. If the content is less than 0.1% by weight, a sufficient density of cross-linking for obtaining a desired durability cannot be obtained. If the content exceeds 5% by weight, the density of cross-linking becomes excessively high so that the surface of the carpet is hardened while degrading feeling of the surface portion of the carpet.

In production of the functional carpet according to the present invention, the surface treatment agent (or the aqueous emulsion) is sprayed onto the surface of the nonwoven fabric serving as the base fabric of the carpet. Thereafter, the nonwoven fabric coated with the surface treatment agent is heated to be dried by using a hot flow, a hot tenter or the like so as to accomplish the heat treatment of the surface treatment agent, thus forming the functional carpet. The heat treatment includes heating the nonwoven fabric coated with the surface treatment agent preferably at a temperature (heat treatment temperature) ranging from 100 to 200° C. and for a time (heat treatment time) ranging from 20 seconds to 10 minutes under a dry condition. If the heat treatment temperature is lower than 100° C., the speed of the cross-linking reaction is low so as to make incomplete solidification of the surface treatment agent. If the heat treatment temperature exceeds 200° C., there arises the possibility of the nonwoven fabric serving as the base fabric of the carpet being softened and molten under such a high temperature. Additionally, if the heat treatment time is shorter than 20 seconds, the cross-linking reaction of the fluoroplastics in the surface treatment agent is not sufficiently made so that solidification of the surface treatment agent becomes insufficient. If the heat treatment time exceeds 10 minutes, not only the base fabric (or the nonwoven fabric) of the carpet is damaged to be scorched under heat but also operational efficiency in production is lowered thereby to raise production cost of the carpet. It is to be noted that the surface quality of the carpet tends to degrade as the thermal history of the carpet increases, and therefore it is preferably avoided that the nonwoven fabric coated with the surface treatment is subjected to a heat treatment in a high temperature region over 10 minutes even though the high temperature region is lower than the above-mentioned upper limit of 200° C. In order to facilitate the production of the carpet, it is preferable to continuously carry out the step of production of the base fabric (or the nonwoven fabric), the step of spraying the surface treatment agent onto the base fabric, and the step of the heat treatment.

The resultant functional carpet produced in the method discussed above includes the nonwoven fabric which has piles formed throughout the whole surface of the nonwoven fabric and has the density ranging from 250 to 800 g/m$^2$, in which the piles project from the surface of said nonwoven fabric and formed of at least a part of fibers constituting said nonwoven fabric. The fluoroplastics is adhered to or impregnated in the surface portion of the nonwoven fabric and extends uniformly throughout the surface of the nonwoven fabric. The fluoroplastics includes linear tetrafluoroethylene telomer(s) as a main body. The tetrafluoroethylene telomer has a number of carbon atoms ranging from 6 to 14. The amount (in solid state) of the fluoroplastics impregnated in the surface portion of said nonwoven fabric ranges from 1.5 to 60 g/m$^2$. Preferably, the tetrafluoroethylene telomer is cross-linked by a compound containing isocyanato group, particularly polyurethane. Accordingly, the resultant functional carpet is provided with high water repellency, oil repellency and soil resistance which are also high in durability while maintaining good feeling of the surface portion of the carpet. Thus, this functional carpet is suitably useable as a carpet for use in an automotive vehicle.

EXAMPLES

The present invention will be understood more readily with reference to the following examples and comparative examples; however, these examples are intended to illustrate the invention and are not to be construed to limit the scope of the invention. Each functional carpet produced according to the examples and the comparative examples was subjected to performance tests for evaluating a soil resistance, a soil resistance durability and a water repellency. The soil resistance was measured by conducting a soiling test according to Item 8 of Japanese Industrial Standard (JIS) No. L1023 and indicated as a gray scale classification. The soil resistance durability was measured by repeating the above soiling test six times and indicated as the gray scale classification. In the gray scale classification, the number of Class (in Table 2) rises with improvement in performance. The water repellency was measured as follows: 10 drops of a 20% aqueous solution of isopropyl alcohol were fallen onto the surface of a sample (or each functional carpet). Upon lapse of 5 minutes, the number of the drops left on the surface of the sample was measured as indicated as a volume percentage (%) of the liquid left on the surface.

Example 1

A nonwoven fabric was first prepared through steps of carding, cross-layering, and needle-punching for raw material fibers, in which the nonwoven fabric had a density of 300 g/m$^2$. Then, fork needles were thrust into the resultant nonwoven fabric from one side surface of the nonwoven fabric in a manner to pierce the nonwoven fabric, thereby forming piles at the surface of the nonwoven fabric. Thereafter, the nonwoven fabric was subjected to a shearing or cropping treatment to form a dilour-tone pattern at the surface portion of the nonwoven fabric, thus obtaining a carpet base fabric having the piles of about 5 mm length (pile length). An aqueous emulsion serving as a surface treatment agent was coated at the surface of the resultant carpet base fabric (or the nonwoven fabric) in an amount of 150 g/m$^2$, in which the aqueous emulsion contained 15% by weight (fluoroplastics content) of fluoroplastics and 1% by weight (cross-linking agent content) of polyurethane resin as a cross-linking agent. The fluoroplastics included tetrafluoroethylene telomer as a main body, in which the numbers of carbon atoms in major tetrafluoroethylene telomers were 6, 8 and 12. Thereafter, the carpet base fabric coated with the aqueous emulsion was subjected to a dry heat treatment at a temperature (heat treatment temperature) of about 140° C. and for a time (heat treatment time) of about 3 minutes, thus producing a functional carpet. The configuration of the nonwoven fabric, the composition of the surface treatment agent and the condition of the heat treatment were tabulated and shown in Table 1. Lastly, performance tests were conducted on the thus produced functional carpet to evaluate the soil resistance, the soil resistance durability and the water repellency. The results of the performance tests were tabulated and shown in Table 2. The results revealed that the functional carpet of this Example was excellent in soil resistance performance and water repellency.

Example 2

A nonwoven fabric was first prepared through steps of carding, cross-layering, and needle-punching for raw material fibers, in which the nonwoven fabric had a density of 800 g/m$^2$. Then, fork needles were thrust into the resultant nonwoven fabric from one side surface of the nonwoven fabric in a manner to pierce the nonwoven fabric, thereby forming piles at the surface of the nonwoven fabric. Thereafter, the nonwoven fabric was subjected to a shearing or cropping treatment to form a dilour-tone pattern at the surface portion of the nonwoven fabric, thus obtaining a carpet base fabric having the piles of about 5 mm length (pile length). An aqueous emulsion serving as a surface treatment agent was coated at the surface of the resultant carpet base fabric (or the nonwoven fabric) in an amount of 300 g/m$^2$, in which the aqueous emulsion contained 20% by weight (fluoroplastics content) of fluoroplastics and 5% by weight (cross-linking agent content) of polyurethane resin as a cross-linking agent. The fluoroplastics included tetrafluoroethylene telomer as a main body, in which the numbers of carbon atoms in major tetrafluoroethylene telomers were 8, 12 and 14. Thereafter, the carpet base fabric coated with the aqueous emulsion was subjected to a dry heat treatment at a temperature (heat treatment temperature) of about 180° C. and for a time (heat treatment time) of about 10 minutes, thus producing a functional carpet. The configuration of the nonwoven fabric, the composition of the surface treatment agent and the condition of the heat treatment were tabulated and shown in Table 1. Lastly, performance tests were conducted on the thus produced functional carpet to evaluate the soil resistance, the soil resistance durability and the water repellency. The results of the performance tests were tabulated and shown in Table 2. The results revealed that the functional carpet of this Example was excellent in soil resistance performance and water repellency.

Example 3

A nonwoven fabric was first prepared through steps of carding, cross-layering, and needle-punching for raw material fibers, in which the nonwoven fabric had a density of 250 g/m$^2$. Then, fork needles were thrust into the resultant nonwoven fabric from one side surface of the nonwoven fabric in a manner to pierce the nonwoven fabric, thereby forming piles at the surface of the nonwoven fabric. Thereafter, the nonwoven fabric was subjected to a shearing or cropping treatment to form a dilour-tone pattern at the surface portion of the nonwoven fabric, thus obtaining a carpet base fabric having the piles of about 1 mm length (pile length). An aqueous emulsion serving as a surface treatment agent was coated at the surface of the resultant carpet base fabric (or the nonwoven fabric) in an amount of 50 g/m$^2$, in which the aqueous emulsion contained 3% by weight (fluoroplastics content) of fluoroplastics and 0.1% by weight (cross-linking agent content) of polyurethane resin as a cross-linking agent. The fluoroplastics included tetrafluoroethylene telomer as a main body, in which the numbers of carbon atoms in major tetrafluoroethylene telomers were 6, 8 and 10. Thereafter, the carpet base fabric coated with the aqueous emulsion was subjected to a dry heat treatment at a temperature (heat treatment temperature) of about 200° C. and for a time (heat treatment time) of about 20 seconds, thus producing a functional carpet. The configuration of the nonwoven fabric, the composition of the surface treatment agent and the condition of the heat treatment were tabulated and shown in Table 1. Lastly, performance tests were conducted on the thus produced functional carpet to evaluate the soil resistance, the soil resistance durability and the water repellency. The results of the performance tests were tabulated and shown in Table 2. The results revealed that the functional carpet of this Example was excellent in soil resistance performance and water repellency.

Example 4

A nonwoven fabric was first prepared through steps of carding, cross-layering, and needle-punching for raw material fibers, in which the nonwoven fabric had a density of 600 g/m$^2$. Then, fork needles were thrust into the resultant nonwoven fabric from one side surface of the nonwoven fabric in a manner to pierce the nonwoven fabric, thereby forming piles at the surface of the nonwoven fabric. Thereafter, the nonwoven fabric was subjected to a shearing or cropping treatment to form a dilour-tone pattern at the surface portion of the nonwoven fabric, thus obtaining a carpet base fabric having the piles of about 10 mm length (pile length). An aqueous emulsion serving as a surface treatment agent was coated at the surface of the resultant carpet base fabric (or the nonwoven fabric) in an amount of 200 g/m$^2$, in which the aqueous emulsion contained 13% by weight (fluoroplastics content) of fluoroplastics and 1.5% by weight (cross-linking agent content) of polyurethane resin as a cross-linking agent. The fluoroplastics included tetrafluoroethylene telomer as a main body, in which the numbers of carbon atoms in major tetrafluoroethylene telomers were 6, 8 and 10. Thereafter, the carpet base fabric coated with the aqueous emulsion was subjected to a dry heat treatment at a temperature (heat treatment temperature) of about 140° C. and for a time (heat treatment time) of about 7 minutes, thus producing a functional carpet. The configuration of the nonwoven fabric, the composition of the surface treatment agent and the condition of the heat treatment were tabulated and shown in Table 1. Lastly, performance tests were conducted on the thus produced functional carpet to evaluate the soil resistance, the soil resistance durability and the water repellency. The results of the performance tests were tabulated and shown in Table 2. The results revealed that the functional carpet of this Example was excellent in soil resistance performance and water repellency.

Example 5

A nonwoven fabric was first prepared through steps of carding, cross-layering, and needle-punching for raw material fibers, in which the nonwoven fabric had a density of 300 g/m$^2$. Then, fork needles were thrust into the resultant nonwoven fabric from one side surface of the nonwoven fabric in a manner to pierce the nonwoven fabric, thereby forming piles at the surface of the nonwoven fabric. Thereafter, the nonwoven fabric was subjected to a shearing or cropping treatment to form a dilour-tone pattern at the surface portion of the nonwoven fabric, thus obtaining a carpet base fabric having the piles of about 5 mm length (pile length). An aqueous emulsion serving as a surface treatment agent was coated at the surface of the resultant carpet base fabric (or the nonwoven fabric) in an amount of 120 g/m$^2$, in which the aqueous emulsion contained 15% by weight (fluoroplastics content) of fluoroplastics and 1% by weight (cross-linking agent content) of polyurethane resin as a cross-linking agent. The fluoroplastics included tetrafluoroethylene telomer as a main body, in which the numbers of carbon atoms in major tetrafluoroethylene telomers were 8, 10 and 12. Thereafter, the carpet base fabric coated with the aqueous emulsion was subjected to a dry heat treatment at a temperature (heat treatment temperature) of about 100° C. and for a time (heat treatment time) of about 8 minutes, thus producing a functional carpet. The configuration of the nonwoven fabric, the composition of the surface treatment agent and the condition of the heat treatment were tabulated and shown in Table 1. Lastly, performance tests were conducted on the thus produced functional carpet to evaluate the soil resistance, the soil resistance durability and the water repellency. The results of the performance tests were tabulated and shown in Table 2. The results revealed that the functional carpet of this Example was excellent in soil resistance performance and water repellency.

Comparative Example 1

A nonwoven fabric was first prepared through steps of carding, cross-layering, and needle-punching for raw material fibers, in which the nonwoven fabric had a density of 200 g/m$^2$. Then, fork needles were thrust into the resultant nonwoven fabric from one side surface of the nonwoven fabric in a manner to pierce the nonwoven fabric, thereby forming piles at the surface of the nonwoven fabric. Thereafter, the nonwoven fabric was subjected to a shearing or cropping treatment to form a dilour-tone pattern at the surface portion of the nonwoven fabric, thus obtaining a carpet base fabric having the piles of about 0.5 mm length (pile length). An aqueous emulsion serving as a surface treatment agent was coated at the surface of the resultant carpet base fabric (or the nonwoven fabric) in an amount of 150 g/m$^2$, in which the aqueous emulsion contained 15% by weight (fluoroplastics content) of fluoroplastics and 1% by weight (cross-linking agent content) of polyurethane resin as a cross-linking agent. The fluoroplastics included tetrafluoroethylene telomer as a main body, in which the numbers of carbon atoms in major tetrafluoroethylene telomers were 8, 10 and 12. Thereafter, the carpet base fabric coated with the aqueous emulsion was subjected to a dry heat treatment at a temperature (heat treatment temperature) of about 140° C. and for a time (heat treatment time) of about 2 minutes, thus producing a functional carpet. The configuration of the nonwoven fabric, the composition of the surface treatment agent and the condition of the heat treatment were tabulated and shown in Table 1. Lastly, performance tests were conducted on the thus produced functional carpet to evaluate the soil resistance, the soil resistance durability and the water repellency. The results of the performance tests were tabulated and shown in Table 2. The results revealed that the functional carpet of this Comparative Example was good in water repellency but was degraded in feeling of its surface portion because of solidification of the surface portion. Additionally, the resultant functional carpet was formed with thin and see-through sections and therefore was inferior in appearance.

Comparative Example 2

A nonwoven fabric was first prepared through steps of carding, cross-layering, and needle-punching for raw material fibers, in which the nonwoven fabric had a density of 300 g/m$^2$. Then, fork needles were thrust into the resultant nonwoven fabric from one side surface of the nonwoven fabric in a manner to pierce the nonwoven fabric, thereby forming piles at the surface of the nonwoven fabric. Thereafter, the nonwoven fabric was subjected to a shearing or cropping treatment to form a dilour-tone pattern at the surface portion of the nonwoven fabric, thus obtaining a carpet base fabric having the piles of about 5 mm length (pile length). An aqueous emulsion serving as a surface treatment agent was coated at the surface of the resultant carpet base fabric (or the nonwoven fabric) in an amount of 150 g/m$^2$, in which the aqueous emulsion contained 15% by weight (fluoroplastics content) of fluoroplastics and 1% by weight (cross-linking agent content) of epoxy resin as a cross-linking agent. The fluoroplastics included tetrafluoroethylene telomer as a main body, in which the numbers of carbon atoms in major tetrafluoroethylene telomers were 8, 10 and 12. Thereafter, the carpet base fabric coated with the aqueous emulsion was subjected to a dry heat treatment at a temperature (heat treatment temperature) of about 140° C. and for a time (heat treatment time) of about 3 minutes, thus producing a functional carpet. The configuration of the nonwoven fabric, the composition of the surface treatment agent and the condition of the heat treatment were tabulated and shown in Table 1. Lastly, performance tests were conducted on the thus produced functional carpet to evaluate the soil resistance, the soil resistance durability and the water repellency. The results of the performance tests were tabulated and shown in Table 2. The results revealed that the functional carpet of this Comparative Example was good in initial performance of soil resistance performance and water repellency but was confirmed to be considerably degraded in durability of the soil resistance functions.

Comparative Example 3

A nonwoven fabric was first prepared through steps of carding, cross-layering, and needle-punching for raw material fibers, in which the nonwoven fabric had a density of 1000 g/m$^2$. Then, fork needles were thrust into the resultant nonwoven fabric from one side surface of the nonwoven fabric in a manner to pierce the nonwoven fabric, thereby forming piles at the surface of the nonwoven fabric. Thereafter, the nonwoven fabric was subjected to a shearing or cropping treatment to form a dilour-tone pattern at the surface portion of the nonwoven fabric, thus obtaining a carpet base fabric having the piles of about 5 mm length (pile length). An aqueous emulsion serving as a surface treatment agent was coated at the surface of the resultant carpet base fabric (or the nonwoven fabric) in an amount of 300 g/m$^2$, in which the aqueous emulsion contained 20% by weight (fluoroplastics content) of fluoroplastics and 5% by weight (cross-linking agent content) of polyurethane resin as a cross-linking agent. The fluoroplastics included tetrafluoroethylene telomer as a main body, in which the numbers of carbon atoms in major tetrafluoroethylene telomers were 12, 14 and 16. Thereafter, the carpet base fabric coated with the aqueous emulsion was subjected to a dry heat treatment at a temperature (heat treatment temperature) of about 140° C. and for a time (heat treatment time) of about 7 minutes, thus producing a functional carpet. The configuration of the nonwoven fabric, the composition of the surface treatment agent and the condition of the heat treatment were tabulated and shown in Table 1. Lastly, performance tests were conducted on the thus produced functional carpet to evaluate the soil resistance, the soil resistance durability and the water repellency. The results of the performance tests were tabulated and shown in Table 2. The results revealed that the functional carpet of this Comparative Example was inferior in permeability of the aqueous emulsion because of a high density of the nonwoven fabric, so that a desired performance could not be obtained in soil resistance.

Comparative Example 4

A nonwoven fabric was first prepared through steps of carding, cross-layering, and needle-punching for raw material fibers, in which the nonwoven fabric had a density of 600 g/m$^2$. Then, fork needles were thrust into the resultant nonwoven fabric from one side surface of the nonwoven fabric in a manner to pierce the nonwoven fabric, thereby forming piles at the surface of the nonwoven fabric. Thereafter, the nonwoven fabric was subjected to a shearing or cropping treatment to form a dilour-tone pattern at the surface portion of the nonwoven fabric, thus obtaining a carpet base fabric having the piles of about 12 mm length (pile length). An aqueous emulsion serving as a surface treatment agent was coated at the surface of the resultant carpet base fabric (or the nonwoven fabric) in an amount of 400 g/m$^2$, in which the aqueous emulsion contained 30% by weight (fluoroplastics content) of fluoroplastics and 5% by weight (cross-linking agent content) of polyurethane resin as a cross-linking agent. The fluoroplastics included tetrafluoroethylene telomer as a main body, in which the numbers of carbon atoms in major tetrafluoroethylene telomers were 6, 8 and 10. Thereafter, the carpet base fabric coated with the aqueous emulsion was subjected to a dry heat treatment at a temperature (heat treatment temperature) of about 140° C. and for a time (heat treatment time) of about 10 minutes, thus producing a functional carpet. The configuration of the nonwoven fabric, the composition of the surface treatment agent and the condition of the heat treatment were tabulated and shown in Table 1. Lastly, performance tests were conducted on the thus produced functional carpet to evaluate the soil resistance, the soil resistance durability and the water repellency. The results of the performance tests were tabulated and shown in Table 2. The results revealed that the functional carpet of this Comparative Example was confirmed that the fluoroplastics was crystallized and chalked because of a too much amount of the surface treatment agent, and therefore the surface quality was degraded.

Comparative Example 5

A nonwoven fabric was first prepared through steps of carding, cross-layering, and needle-punching for raw material fibers, in which the nonwoven fabric had a density of 300 g/m$^2$. Then, fork needles were thrust into the resultant nonwoven fabric from one side surface of the nonwoven fabric in a manner to pierce the nonwoven fabric, thereby forming piles at the surface of the nonwoven fabric. Thereafter, the nonwoven fabric was subjected to a shearing or cropping treatment to form a dilour-tone pattern at the surface portion of the nonwoven fabric, thus obtaining a carpet base fabric having the piles of about 5 mm length (pile length). An aqueous emulsion serving as a surface treatment agent was coated at the surface of the resultant carpet base fabric (or the nonwoven fabric) in an amount of 40 g/m$^2$, in which the aqueous emulsion contained 2% by weight (fluoroplastics content) of fluoroplastics and 1% by weight (cross-linking agent content) of polyurethane resin as a cross-linking agent. The fluoroplastics included tetrafluoroethylene telomer as a main body, in which the numbers of carbon atoms in major tetrafluoroethylene telomers were 6, 8 and 10. Thereafter, the carpet base fabric coated with the aqueous emulsion was subjected to a dry heat treatment at a temperature (heat treatment temperature) of about 140° C. and for a time (heat treatment time) of about 6 minutes, thus producing a functional carpet. The configuration of the nonwoven fabric, the composition of the surface treatment agent and the condition of the heat treatment were tabulated and shown in Table 1. Lastly, performance tests were conducted on the thus produced functional carpet to evaluate the soil resistance, the soil resistance durability and the water repellency. The results of the performance tests were tabulated and shown in Table 2. The results revealed that the functional carpet of this Comparative Example was confirmed to be difficult to obtain a desired performance both in water repellency and soil resistance functions because of shortage in coated amount of the surface treatment agent.

Comparative Example 6

A nonwoven fabric was first prepared through steps of carding, cross-layering, and needle-punching for raw material fibers, in which the nonwoven fabric had a density of 300 g/m$^2$. Then, fork needles were thrust into the resultant nonwoven fabric from one side surface of the nonwoven fabric in a manner to pierce the nonwoven fabric, thereby forming piles at the surface of the nonwoven fabric. Thereafter, the nonwoven fabric was subjected to a shearing or cropping treatment to form a dilour-tone pattern at the surface portion of the nonwoven fabric, thus obtaining a carpet base fabric having the piles of about 5 mm length (pile length). An aqueous emulsion serving as a surface treatment agent was coated at the surface of the resultant carpet base fabric (or the nonwoven fabric) in an amount of 100 g/m$^2$, in which the aqueous emulsion contained 5% by weight (fluoroplastics content) of fluoroplastics and 0.05% by weight (cross-linking agent content) of polyurethane resin as a cross-linking agent. The fluoroplastics included tetrafluoroethylene telomer as a main body, in which the numbers of carbon atoms in major tetrafluoroethylene telomers were 4 and 6. Thereafter, the carpet base fabric coated with the aqueous emulsion was subjected to a dry heat treatment at a temperature (heat treatment temperature) of about 80° C. and for a time (heat treatment time) of about 2 minutes, thus producing a functional carpet. The configuration of the nonwoven fabric, the composition of the surface treatment agent and the condition of the heat treatment were tabulated and shown in Table 1. Lastly, performance tests were conducted on the thus produced functional carpet to evaluate the soil resistance, the soil resistance durability and the water repellency. The results of the performance tests were tabulated and shown in Table 2. The results revealed that the functional carpet of this Comparative Example was good in initial performance of both water repellency and soil resistance functions but was inferior in durability of the soil resistance functions because of a low density of cross-linking of the fluoroplastics.

Comparative Example 7

A nonwoven fabric was first prepared through steps of carding, cross-layering, and needle-punching for raw material fibers, in which the nonwoven fabric had a density of 300 g/m$^2$. Then, fork needles were thrust into the resultant nonwoven fabric from one side surface of the nonwoven fabric in a manner to pierce the nonwoven fabric, thereby forming piles at the surface of the nonwoven fabric. Thereafter, the nonwoven fabric was subjected to a shearing or cropping treatment to form a dilour-tone pattern at the surface portion of the nonwoven fabric, thus obtaining a carpet base fabric having the piles of about 5 mm length (pile length). An aqueous emulsion serving as a surface treatment agent was coated at the surface of the resultant carpet base fabric (or the nonwoven fabric) in an amount of 150 g/m$^2$, in which the aqueous emulsion contained 15% by weight (fluoroplastics content) of fluoroplastics and 1.5% by weight (cross-linking agent content) of polyurethane resin as a cross-linking agent. The fluoroplastics included tetrafluoroethylene telomer as a main body, in which the numbers of carbon atoms in major tetrafluoroethylene telomers were 6, 8 and 10. Thereafter, the carpet base fabric coated with the aqueous emulsion was subjected to a dry heat treatment at a temperature (heat treatment temperature) of about 220° C. and for a time (heat treatment time) of about 1 minute, thus producing a functional carpet. The configuration of the nonwoven fabric, the composition of the surface treatment agent and the condition of the heat treatment were tabulated and shown in Table 1. Lastly, performance tests were conducted on the thus produced functional carpet to evaluate the soil resistance, the soil resistance durability and the water repellency. The results of the performance tests were tabulated and shown in Table 2. The results revealed that the functional carpet of this Comparative Example was confirmed to be scorched at its surface portion and to make falling-down of the piles, and therefore the surface quality was degraded.

Comparative Example 8

A nonwoven fabric was first prepared through steps of carding, cross-layering, and needle-punching for raw material fibers, in which the nonwoven fabric had a density of 300 g/m$^2$. Then, fork needles were thrust into the resultant nonwoven fabric from one side surface of the nonwoven fabric in a manner to pierce the nonwoven fabric, thereby forming piles at the surface of the nonwoven fabric. Thereafter, the nonwoven fabric was subjected to a shearing or cropping treatment to form a dilour-tone pattern at the surface portion of the nonwoven fabric, thus obtaining a carpet base fabric having the piles of about 5 mm length (pile length). An aqueous emulsion serving as a surface treatment agent was coated at the surface of the resultant carpet base fabric (or the nonwoven fabric) in an amount of 150 g/m$^2$, in which the aqueous emulsion contained 15% by weight (fluoroplastics content) of fluoroplastics and 1.5% by weight (cross-linking agent content) of polyurethane resin as a cross-linking agent. The fluoroplastics included tetrafluoroethylene telomer as a main body, in which the numbers of carbon atoms in major tetrafluoroethylene telomers were 6, 8 and 10. Thereafter, the carpet base fabric coated with the aqueous emulsion was subjected to a dry heat treatment at a temperature (heat treatment temperature) of about 220° C. and for a time (heat treatment time) of about 15 seconds, thus producing a functional carpet. The configuration of the nonwoven fabric, the composition of the surface treatment agent and the condition of the heat treatment were tabulated and shown in Table 1. Lastly, performance tests were conducted on the thus produced functional carpet to evaluate the soil resistance, the soil resistance durability and the water repellency. The results of the performance tests were tabulated and shown in Table 2. The results revealed that the functional carpet of this Comparative Example was confirmed to be difficult to obtain a desired performance in either water repellency and soil resistance functions because of the fact that cross-linking reaction of the fluoroplastics could not sufficiently proceed under shortage in heat treatment so that the surface treatment agent was insufficient in its solidification and fixation to the nonwoven fabric.

TABLE 1

| No. | Experiment | Density of nonwoven fabric (g/m$^2$) | Pile length (mm) | Fluoroplastics content (wt %) | Number of carbons in major telomers | Functional group in cross-linking agent | Cross-linking agent content (wt %) | Coated amount of surface treatment agent (g/m$^2$) | Heat treatment temp. (° C.) | Heat treatment time (sec.) |
|---|---|---|---|---|---|---|---|---|---|---|
| 1 | Example 1 | 300 | 5 | 15 | 6, 8, 12 | Isocyanato group | 1 | 150 | 140 | 180 |
| 2 | Example 2 | 800 | 5 | 20 | 8, 12, 14 | Isocyanato group | 5 | 300 | 180 | 600 |
| 3 | Example 3 | 250 | 1 | 3 | 6, 8, 10 | Isocyanato group | 0.1 | 50 | 200 | 20 |
| 4 | Example 4 | 600 | 10 | 13 | 6, 8, 10 | Isocyanato group | 1.5 | 200 | 140 | 420 |
| 5 | Example 5 | 300 | 5 | 15 | 8, 10, 12 | Isocyanato group | 1 | 120 | 100 | 480 |
| 6 | Comparative example 1 | 200 | 0.5 | 15 | 8, 10, 12 | Isocyanato group | 1 | 150 | 140 | 120 |
| 7 | Comparative example 2 | 300 | 5 | 15 | 8, 10, 12 | Epoxy group | 1 | 150 | 140 | 180 |
| 8 | Comparative example 3 | 1000 | 5 | 20 | 12, 14, 16 | Isocyanato group | 5 | 300 | 140 | 420 |
| 9 | Comparative example 4 | 600 | 12 | 30 | 6, 8, 10 | Isocyanato group | 5 | 400 | 140 | 600 |
| 10 | Comparative example 5 | 300 | 5 | 2 | 6, 8, 10 | Isocyanato group | 1 | 40 | 140 | 360 |
| 11 | Comparative example 6 | 300 | 5 | 5 | 4, 6 | Isocyanato group | 0.05 | 100 | 80 | 180 |
| 12 | Comparative example 7 | 300 | 5 | 15 | 6, 8, 10 | Isocyanato group | 1.5 | 150 | 220 | 60 |
| 13 | Comparative example 8 | 300 | 5 | 15 | 6, 8, 10 | Isocyanato group | 1.5 | 150 | 200 | 15 |

TABLE 2

| No. | Experiment | Soil resistance | Soil resistance durability | Water repellency | Note |
|---|---|---|---|---|---|
| 1 | Example 1 | 5 Class | 3.5 Class | 100% | |
| 2 | Example 2 | 4 Class | 3 Class | 100% | |

TABLE 2-continued

| No. | Experiment | Soil resistance | Soil resistance durability | Water repellency | Note |
|---|---|---|---|---|---|
| 3 | Example 3 | 5 Class | 3.5 Class | 100% | |
| 4 | Example 4 | 4 Class | 3 Class | 90% | |
| 5 | Example 5 | 5 Class | 3.5 Class | 100% | |
| 6 | Comparative example 1 | 4 Class | 3 Class | 80% | Surface feeling degraded |
| 7 | Comparative example 2 | 3.5 Class | 1.5 Class | 40% | |
| 8 | Comparative example 3 | 2 Class | 1 Class | 0% | |
| 9 | Comparative example 4 | 1.5 Class | 1 Class | 0% | Surface chalked |
| 10 | Comparative example 5 | 1 Class | 1 Class | 0% | |
| 11 | Comparative example 6 | 3 Class | 1 Class | 60% | |
| 12 | Comparative example 7 | — | — | — | |
| 13 | Comparative example 8 | 1 Class | 1 Class | 0% | |

What is claimed is:

1. A functional carpet comprising a nonwoven fabric having piles formed throughout a whole surface of said nonwoven fabric, each pile projecting from the surface of said nonwoven fabric and being formed of at least a part of fibers constituting said nonwoven fabric, each pile having a length ranging from 1 to 10 mm, said nonwoven fabric having a density ranging from 250 to 800 g/m$^2$; and a fluoroplastics adhered to a surface portion of said nonwoven fabric and extend substantially uniformly throughout the surface of said nonwoven fabric, said fluoroplastics including linear tetrafluoroethylene telomer as a main body, said tetrafluoroethylene telomer having a number of carbon atoms ranging from 6 to 14, an amount of said fluoroplastics adhered to the surface portion of said nonwoven fabric ranging from 1.5 to 60 g/m$^2$ in solid state.

2. A functional carpet as claimed in claim 1, wherein said fluoroplastics is cross-linked under reaction of a compound containing isocyanato group.

3. A functional carpet as claimed in claim 1, wherein said fluoroplastics is cross-linked under reaction of polyurethane.

4. A functional carpet as claimed in claim 2, wherein each tetrafluoroethylene telomer has at least one functional group which is reactive with isocyanato group to make cross-linking of tetrafluoroethylene telomer.

5. A method of producing a functional carpet, comprising the following steps in the sequence set forth:

preparing a nonwoven fabric having piles formed throughout a whole surface of said nonwoven fabric, each pile projecting from the surface of said nonwoven fabric and formed of at least a part of fibers constituting said nonwoven fabric, each pile having a length ranging from 1 to 10 mm, said nonwoven fabric having a density ranging from 250 to 800 g/m$^2$;

coating an aqueous emulsion (or a surface treatment agent) at the surface of said nonwoven fabric to extend substantially uniformly throughout the surface of said nonwoven fabric, said emulsion containing fluoroplastics as a main component, in an amount ranging from 3 to 20% by weight, said fluoroplastics including linear tetrafluoroethylene telomer as a main body, said tetrafluoroethylene telomer having a number of carbon atoms ranging from 6 to 14, an amount of said aqueous emulsion coated at the surface of said nonwoven fabric ranging from 50 to 300 g per 1 m$^2$ of said nonwoven fabric; and heating said nonwoven fabric coated with said aqueous emulsion coated so that said fluoroplastics is cross-linked and solidified to obtain an amount of said fluoroplastics adhered to a surface portion of said nonwoven fabric, ranging from 1.5 to 60 g/m$^2$ in solid state (eat treatment).

6. A method as claimed in claim 5, wherein said fluoroplastics is cross-linked under reaction of a compound containing isocyanato group.

7. A method as claimed in claim 5, wherein said fluoroplastics is cross-linked under reaction of polyurethane.

8. A method as claimed in claim 6, wherein each tetrafluoroethylene telomer has at least one functional group which is reactive with isocyanato group to make cross-linking of tetrafluoroethylene telomer.

9. A method as claimed in claim 4, wherein said aqueous emulsion containing polyurethane in an amount ranging from 0.1 to 5% by weight of said aqueous emulsion.

10. A method as claimed in claim 5, wherein the heating step includes heating said nonwoven fabric coated with said aqueous emulsion at a temperature ranging from 100 to 200° C. and for a time ranging from 20 seconds to 10 minutes.

* * * * *